US008181925B1

(12) United States Patent
Miville

(10) Patent No.: US 8,181,925 B1
(45) Date of Patent: May 22, 2012

(54) LADDER MOUNTING PAINT CAN HOLDING ASSEMBLY

(76) Inventor: Roger D. Miville, Iva, SC (US)

( * ) Notice: Subject to any disclaimer, the term of this patent is extended or adjusted under 35 U.S.C. 154(b) by 0 days.

(21) Appl. No.: 13/104,326

(22) Filed: May 10, 2011

(51) Int. Cl.
*E06C 7/14* (2006.01)

(52) U.S. Cl. ..... 248/210; 248/238; 248/311.2; 182/121; 182/129

(58) Field of Classification Search ..... 248/210, 248/238, 211, 314, 201, 316.8, 311.2, 205.1, 248/200; 182/120, 121, 122, 126, 129
See application file for complete search history.

(56) References Cited

U.S. PATENT DOCUMENTS

| | | | | |
|---|---|---|---|---|
| 1,509,593 | A * | 9/1924 | Felger | 248/94 |
| 3,584,702 | A * | 6/1971 | Lang | 182/126 |
| 3,738,601 | A * | 6/1973 | Gehringer | 248/210 |
| 4,193,157 | A | 3/1980 | Large | |
| 4,318,521 | A | 3/1982 | Martin et al. | |
| 4,899,970 | A * | 2/1990 | Berzina | 248/210 |
| 5,217,193 | A * | 6/1993 | Drucker | 248/148 |
| 5,588,622 | A | 12/1996 | Gordon, Sr. | |
| 6,450,461 | B1 | 9/2002 | Lohmann | |
| 6,565,051 | B2 * | 5/2003 | Vaglica | 248/210 |
| D605,372 | S | 12/2009 | Wilkinson | |
| 2009/0289154 | A1 | 11/2009 | Gabriel | |

* cited by examiner

*Primary Examiner* — Anita M King

(57) ABSTRACT

A ladder mountable paint can holding assembly includes a panel that has a front side, a back side, a first lateral edge and a second lateral edge. A pair of support engagement members is attached to the panel. One of the support engagement members is positioned adjacent to the first lateral edge and one of the support engagement members is positioned adjacent to second lateral edge. Each of the support engagement members is configured to releasably engage one of the supports of the ladder. A receiving wall for supporting a paint can is attached to and extends outwardly from the front side. The receiving wall has an upper surface orientated perpendicular to the front side. The support engagement members are configured to engage a pair of supports of a ladder at an angle to retain the receiving wall in an approximately horizontal orientation.

14 Claims, 3 Drawing Sheets

LADDER MOUNTING PAINT CAN HOLDING ASSEMBLY

BACKGROUND OF THE DISCLOSURE

1. Field of the Disclosure

The disclosure relates to paint can holding devices and more particularly pertains to a new paint can holding device for holding a can of paint in a horizontal orientation on vertical supports of a ladder.

2. Summary of the Disclosure

An embodiment of the disclosure meets the needs presented above by generally comprising a panel that has a front side, a back side, a first lateral edge and a second lateral edge. A pair of support engagement members is attached to the panel. One of the support engagement members is positioned adjacent to the first lateral edge and one of the support engagement members is positioned adjacent to second lateral edge. Each of the support engagement members is configured to releasably engage one of the supports of the ladder. A receiving wall for supporting a paint can is attached to and extends outwardly from the front side. The receiving wall has an upper surface orientated perpendicular to the front side. The support engagement members are configured to engage a pair of supports of a ladder at an angle to retain the receiving wall in an approximately horizontal orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
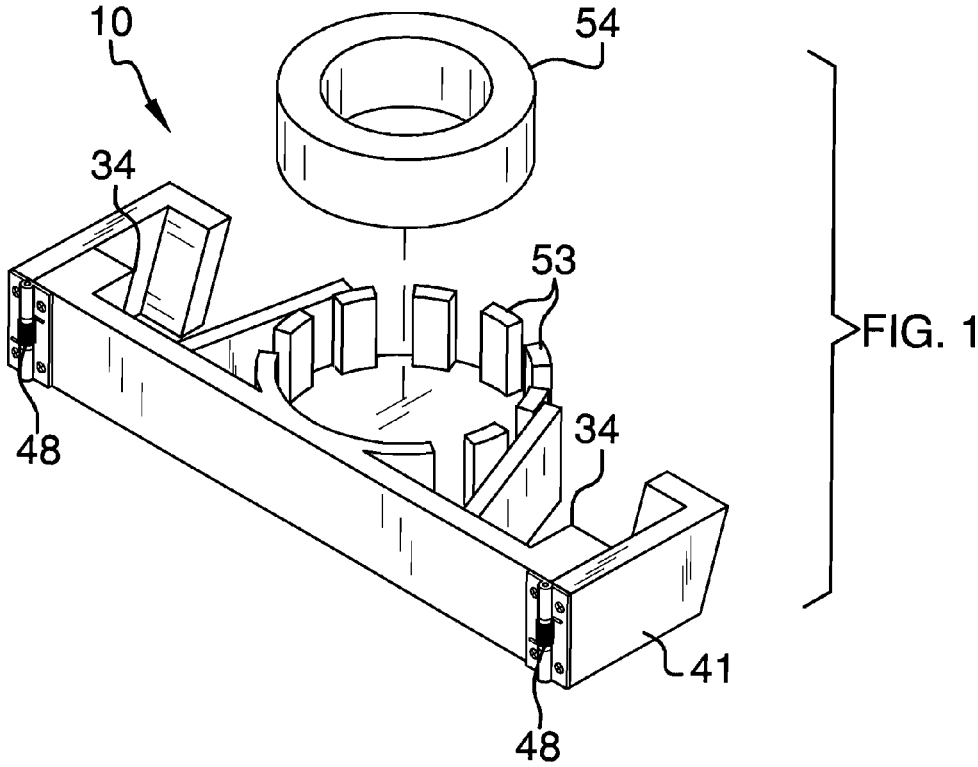
FIG. 1 is a top perspective view of a ladder mountable paint can holding assembly according to an embodiment of the disclosure.
Figure 2:
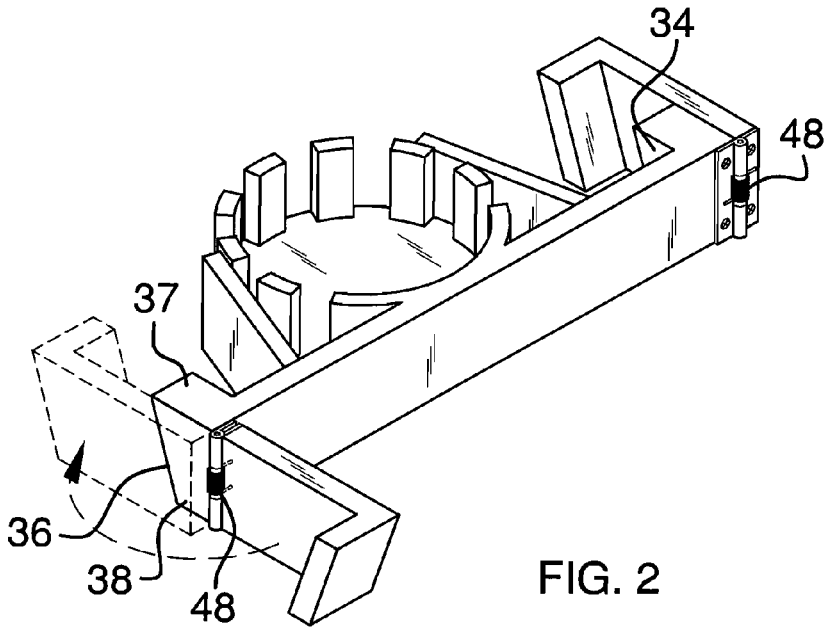
FIG. 2 is a top perspective view of an embodiment of the disclosure.
Figure 3:
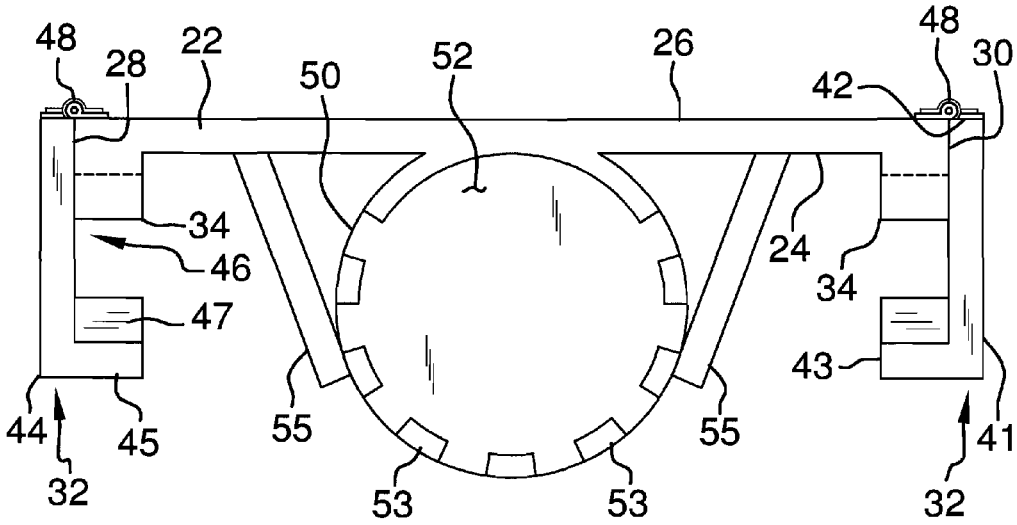
FIG. 3 is a top view of an embodiment of the disclosure.
Figure 4:
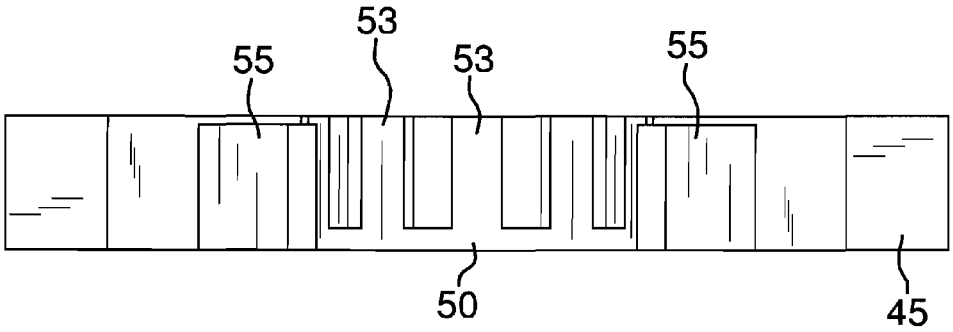
FIG. 4 is a rear view of an embodiment of the disclosure.

With reference now to the drawings, and in particular to FIGS. 1 through 5 thereof, a new paint can holding device embodying the principles and concepts of an embodiment of the disclosure and generally designated by the reference numeral 10 will be described.

Figure 5:
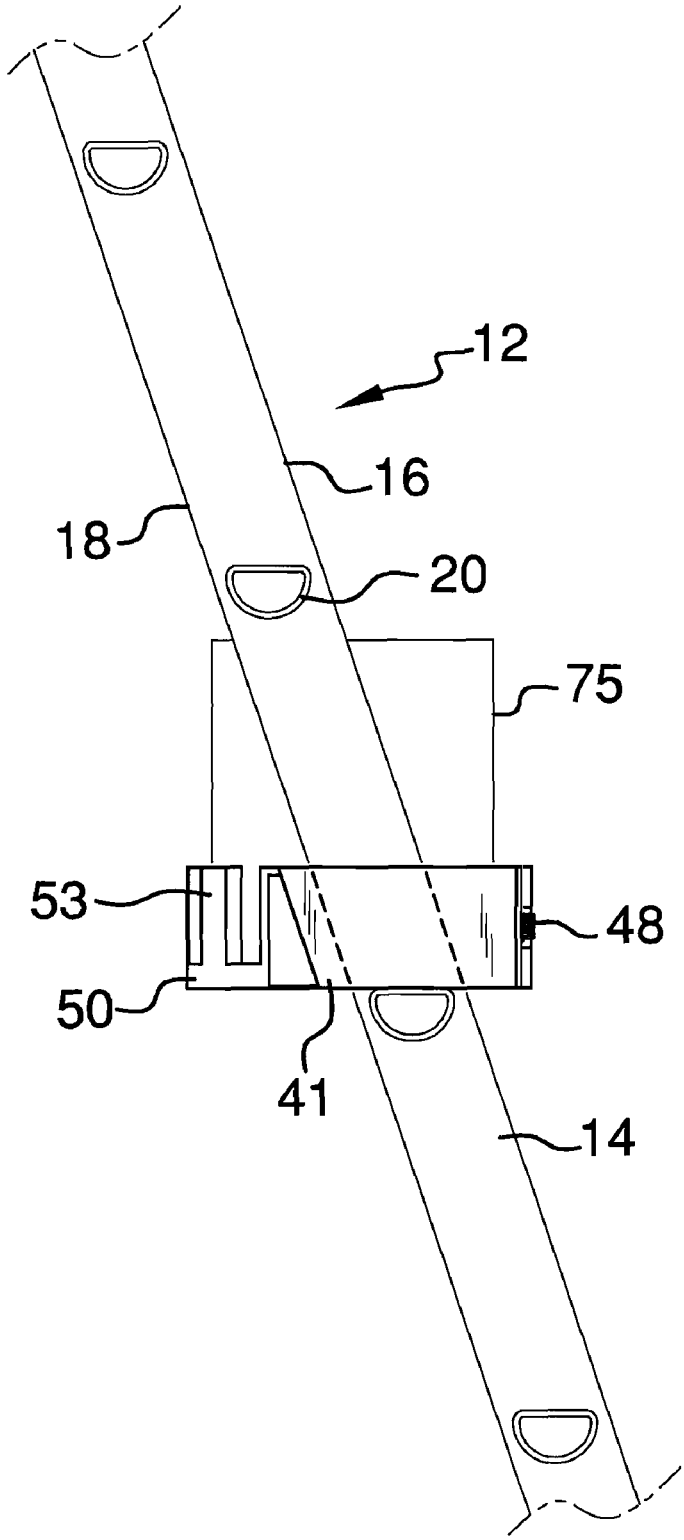
FIG. 5 is a side in-use view of an embodiment of the disclosure.

As best illustrated in FIGS. 1 through 6, the ladder mountable paint can holding assembly 10 generally comprises an assembly 10 removably mountable on a pair of parallel supports 14 of a conventional ladder 12. FIG. 5 only showing one of the supports 14 and a mirror image would be viewed from the opposite side of the assembly 10. The supports 14 of the ladder 12 each have a rear edge 16 and a forward edge 18 that are angled between 55° and 80° upwardly from a horizontal surface when the ladder 12 is positioned in an upright position supported by the horizontal surface. Conventional rungs 20 are positioned on the ladder 12. If the ladder 12 is not a self supporting ladder, the angle should typically be between 60° and 76° to ensure proper stability. If the ladder 12 is a self-supporting ladder including two pairs of supports, the parallel supports 14 will typically be at an angle between 65° and 76°.

The assembly 10 includes a panel 22 that has a front side 24, a back side 26, a first lateral edge 28 and a second lateral edge 30. A pair of support engagement members 32 each is attached to the panel 22. One of the support engagement members 32 is positioned adjacent to the first lateral edge 28 and one of the support engagement members 32 is positioned adjacent to second lateral edge 30. Each of the support engagement members 32 is configured to releasably engage one of the supports 14 of the ladder 12.

Each of the support engagement members 32 comprises an arm 34 that is attached to the front side 24 adjacent to a corresponding one of the first 28 or second 30 lateral edges. The arm 34 has a distal edge 36 with respect to the panel 22. The distal edge 36 is configured to be abutted against the rearward edge 16 of the parallel support 14 of the ladder 12. The arm 34 has an upper edge 37 and a lower edge 38. The distal edge 36 is angled backward from the upper edge 37 to the lower edge 38. An angle formed by the upper edge 37 and the distal edge 36 is between 55° and 80°, and more particularly may be equal to the angle of the supports 14 of the ladder 12. The upper edge 37 is orientated perpendicular to the front side 24.

Each of the support engagement members 32 further includes a leg 41 with an attached end 42 and a free end 43. The attached end 42 is hingedly coupled to the panel 22 adjacent to a corresponding one of the first 28 or second 30 lateral edges. The leg 41 has a bend 44 therein positioned between the attached end 42 and the free end 43. A catch 45 is defined by a portion of the leg 41 between the bend 44 and the free end 43. A receiving space 46 is defined between the catch 45 and the distal edge 36 and is configured to removably receive one of the supports 14 to retain the panel 22 on the ladder 12. The leg 41 is movable between a closed position and an open position. The leg 41 extends perpendicularly away from the front side 24 and forms the receiving space 46 when the leg is in the closed position. The leg 41 extends laterally away from the panel 22 when the leg 41 is in the open position. The catch 45 has a facing side 47 facing the distal edge 36. The facing side 47 and the distal edge 36 are each angled a same angle with respect to each other. A biasing member 48 is attached to the leg 41 and biases the leg 41 in the closed position. The biasing member 48 may comprise a spring.

A receiving wall 50 is configured for supporting a paint can 75 that is attached to and extends outwardly from the front side 24. The receiving wall 50 has an upper surface 52 orientated perpendicular to the front side 24. At least one lateral support 53 is attached to the receiving wall 50 and extends upwardly therefrom. As shown in the Figures, a plurality of lateral supports 53 may be provided. The lateral supports 53 are positioned adjacent to a perimeter edge of the receiving wall 50. An insert 54 may be provided that is removably positioned on the receiving wall 50. The insert 54 reduces a diameter of space that is bounded by the lateral supports 53 to facilitate restriction of movement of smaller diameter cans positioned on the receiving wall 50. One or more braces 55 may be attached to and extend between the receiving wall 50 and the panel 22.

In use, the support engagement members 32 are mounted onto the ladder 12 as indicated above and as shown in the Figures. The support engagement members 32 include surfaces that are angled to match the angle of the supports 14 so that the receiving wall 50 is orientated approximately horizontal to ensure that the paint can 75 remains on the receiving wall 50.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A paint can holding assembly, said assembly being configured to be releasably mounted on a pair of parallel supports of a ladder, the supports of the ladder each having a rear edge and a forward edge being angled between 55° and 80° upwardly from a horizontal surface when the ladder is positioned in an upright position supported by the horizontal surface, said assembly including:

a panel having a front side, a back side, a first lateral edge and a second lateral edge;

a pair of support engagement members each being attached to said panel, one of said support engagement members being positioned adjacent to said first lateral edge and one of said support engagement members being positioned adjacent to said second lateral edge, each of said support engagement members being configured to releasably engage one of the supports of the ladder;

a receiving wall configured for supporting a paint can being attached to and extending outwardly from said front side, said receiving wall having an upper surface orientated perpendicular to said front side, said support engagement members being configured to engage the supports of the ladder at an angle to retain said receiving wall in an approximately horizontal orientation;

wherein each of said support engagement members comprises;

an arm being attached to said front side adjacent to a corresponding one of said first or second lateral edges, said arm having a distal edge with respect to said panel, said distal edge being configured to be abutted against the rearward edge of the parallel support of the ladder, said arm having an upper edge and a lower edge; and a leg including an attached end and a free end, said attached end being hingedly coupled to said panel adjacent to a corresponding one of said first or second lateral edges, said leg having a bend therein positioned between said attached end and said free end, a catch being defined by a portion of said leg between said bend and said free end, wherein a receiving space is defined between said catch and said distal edge configured to removably receive one of the supports to retain said panel on the ladder, said leg being movable between a closed position and an open position, said leg extending perpendicularly away from said front side and forming said receiving space when said leg is in said closed position, said leg extending laterally away from said panel when said leg is in said open position.

2. The assembly according to claim 1, wherein said distal edge is angled backward from said upper edge to said lower edge, an angle formed by said upper edge and said distal edge being between 55° and 80°, said upper edge being orientated perpendicular to said front side.

3. The assembly according to claim 2, wherein said catch has a facing side facing said distal edge, said facing side and said distal edge each being angled a same angle with respect to each other.

4. The assembly according to claim 1, further including a biasing member being attached to said leg and biasing said leg in said closed position.

5. The assembly according to claim 1, further including a plurality of lateral supports being attached to said receiving wall and extending upwardly therefrom, said lateral supports being positioned adjacent to a perimeter edge of said receiving wall.

6. The assembly according to claim 5, further including an insert being removably positioned on said receiving wall, said insert reducing a diameter of space being bounded by said lateral supports to facilitate restriction of movement of smaller diameter cans positioned on said receiving wall.

7. The assembly according to claim 1, further including a brace being attached to and extending between said receiving wall and said panel.

8. A paint can holding assembly, said assembly being configured to be releasably mounted on a pair of parallel supports of a ladder, the supports of ladder each having a rear edge and a forward edge being angled between 55° and 80° upwardly from a horizontal surface when the ladder is positioned in an upright position supported by the horizontal surface, said assembly including:

a panel having a front side, a back side, a first lateral edge and a second lateral edge;

a pair of support engagement members each being attached to said panel, one of said support engagement members being positioned adjacent to said first lateral edge and one of said support engagement members being positioned adjacent to said second lateral edge, each of said support engagement members being configured to releasably engage one of the supports of the ladder, each of said support engagement members comprising;

an arm being attached to said front side adjacent to a corresponding one of said first or second lateral edges, said arm having a distal edge with respect to said panel, said distal edge being configured to be abutted against the rearward edge of the parallel support of the ladder, said arm having an upper edge and a lower edge, said distal edge being angled backward from said upper edge to said lower edge, an angle formed by said upper edge and said distal edge being between 55° and 80°, said upper edge being orientated perpendicular to said front side;

a leg including an attached end and a free end, said attached end being hingedly coupled to said panel adjacent to a corresponding one of said first or second lateral edges, said leg having a bend therein positioned between said attached end and said free end, a catch being defined by a portion of said leg between said bend and said free end, wherein a receiving space is defined between said catch and said distal edge configured to removably receive one of the supports to retain said panel on the ladder, said leg being movable between a closed position and an open position, said leg extending perpendicularly away from said front side and forming said receiving space when said leg is in said closed position, said leg extending laterally away from said panel when said leg is in said open position;

said catch having a facing side facing said distal edge, said facing side and said distal edge each being angled a same angle with respect to each other;

a biasing member being attached to said leg and biasing said leg in said closed position;

a receiving wall configured for supporting a paint can being attached to and extending outwardly from said front side, said receiving wall having an upper surface orientated perpendicular to said front side;

a plurality of lateral supports being attached to said receiving wall and extending upwardly therefrom, said lateral supports being positioned adjacent to a perimeter edge of said receiving wall;

an insert being removably positioned on said receiving wall, said insert reducing a diameter of space being bounded by said lateral supports to facilitate restriction of movement of smaller diameter cans positioned on said receiving wall; and a brace being attached to and extending between said receiving wall and said panel.

9. A paint can holding assembly, said assembly being configured to be releasably mounted on a pair of parallel supports of a ladder, the supports of the ladder each having a rear edge and a forward edge being angled between 55° and 80° upwardly from a horizontal surface when the ladder is positioned in an upright position supported by the horizontal surface, said assembly including:

a panel having a front side, a back side, a first lateral edge and a second lateral edge;

a pair of support engagement members each being attached to said panel, one of said support engagement members being positioned adjacent to said first lateral edge and one of said support engagement members being positioned adjacent to said second lateral edge, each of said support engagement members being configured to releasably engage one of the supports of the ladder;

a receiving wall configured for supporting a paint can being attached to and extending outwardly from said front side, said receiving wall having an upper surface orientated perpendicular to said front side, said support engagement members being configured to engage the supports of the ladder at an angle to retain said receiving wall in an approximately horizontal orientation; and a plurality of lateral supports being attached to said receiving wall and extending upwardly therefrom, said lateral supports being positioned adjacent to a perimeter edge of said receiving wall.

10. The assembly according to claim 9, wherein each of said support engagement members comprises:

an arm being attached to said front side adjacent to a corresponding one of said first or second lateral edges, said arm having a distal edge with respect to said panel, said distal edge being configured to be abutted against the rearward edge of the parallel support of the ladder, said arm having an upper edge and a lower edge;

a leg including an attached end and a free end, said attached end being hingedly coupled to said panel adjacent to a corresponding one of said first or second lateral edges, said leg having a bend therein positioned between said attached end and said free end, a catch being defined by a portion of said leg between said bend and said free end, wherein a receiving space is defined between said catch and said distal edge configured to removably receive one of the supports to retain said panel on the ladder, said leg being movable between a closed position and an open position, said leg extending perpendicularly away from said front side and forming said receiving space when said leg is in said closed position, said leg extending laterally away from said panel when said leg is in said open position;

said distal edge being angled backward from said upper edge to said lower edge, an angle formed by said upper edge and said distal edge being between 55° and 80°, said upper edge being orientated perpendicular to said front side.

11. The assembly according to claim 10, wherein said catch has a facing side facing said distal edge, said facing side and said distal edge each being angled a same angle with respect to each other.

12. The assembly according to claim 9, further including a biasing member being attached to said leg and biasing said leg in said closed position.

13. The assembly according to claim 12, further including an insert being removably positioned on said receiving wall, said insert reducing a diameter of space being bounded by said lateral supports to facilitate restriction of movement of smaller diameter cans positioned on said receiving wall.

14. The assembly according to claim 9, further including a brace being attached to and extending between said receiving wall and said panel.

* * * * *